US005123330A

United States Patent [19]

Roether et al.

[11] Patent Number: 5,123,330

[45] Date of Patent: Jun. 23, 1992

[54] VENT CONDUIT THROUGH POSITION MONITORING DEVICE FOR A WORK CYLINDER

[75] Inventors: Friedbert Roether, Ingersheim; Norbert Schneider, Tiefenbronn; Manfred Siebold, Boeblingen, all of Fed. Rep. of Germany

[73] Assignee: Robert Bosch GmbH, Stuttgart, Fed. Rep. of Germany

[21] Appl. No.: 691,280

[22] Filed: Apr. 25, 1991

[30] Foreign Application Priority Data

Jun. 27, 1990 [DE] Fed. Rep. of Germany ..... 4020368

[51] Int. Cl.[5] ..... F01B 31/12

[52] U.S. Cl. ..... 91/1; 91/459; 92/110

[58] Field of Search ..... 910/1, 459; 92/5 R, 92/110

[56] References Cited

U.S. PATENT DOCUMENTS

| | | | |
|---|---|---|---|
| 2,742,916 | 4/1956 | Side | 91/459 |
| 3,654,549 | 4/1972 | Maurer et al. | 92/5 R |
| 3,659,499 | 5/1972 | Woodward | 91/1 |
| 3,744,218 | 5/1988 | Edwards et al. | 60/368 |
| 3,968,735 | 7/1976 | Boisde et al. | 92/110 |
| 4,259,895 | 4/1981 | Owens | 92/110 |
| 4,727,791 | 3/1988 | Satoh | 91/459 |
| 4,876,945 | 10/1989 | Stoll et al. | 92/5 R |

*Primary Examiner*—Edward K. Look
*Assistant Examiner*—F. Daniel Lopez
*Attorney, Agent, or Firm*—Edwin E. Greigg; Ronald E. Greigg

[57] ABSTRACT

A work cylinder in which the position of a work piston, its distance traveled at a given time and the speed at which it covers this distance are measured by a hollow-cylindrical sensor, and the results are delivered to an electronic switch device. The sensor serves as a passage for the breathing air of a breathing chamber of the work cylinder, as a result of which the sensor can be cooled. The work cylinder is intended for use to control vehicle engine clutches.

10 Claims, 2 Drawing Sheets

VENT CONDUIT THROUGH POSITION MONITORING DEVICE FOR A WORK CYLINDER

BACKGROUND OF THE INVENTION

The invention relates to a work cylinder as defined hereinafter. A work cylinder of this kind is known (German Auslegeschrift 11 48 451). These work cylinders have the disadvantage that the position of the work piston that is movable in the work cylinder has to be known at all times. Suitable electric detection means, such as end switches or the like, are also already known.

Most recently, work cylinders of this type are also used in combination with electronic switch devices, and they are provided on vehicles in which they take on the task of final control elements of electrically controlled clutches of vehicle engines, as an example. In vehicles, there is always the problem that a breathing chamber located behind the work piston must be prevented, as it expands from the piston motion, from aspirating any dirt, or in the winter, air-borne salt. Such foreign substances could in fact cause corrosion and result in blockage of the work cylinder.

It has already been proposed that the breathing chamber be connected to the ambient air via a snorkel with a filter (German Offenlegungsschrift 24 30 394).

A thus-equipped work cylinder can then safely overcome any water damage, because access to the snorkel and its opening can be placed high enough that water will not be aspirated into the breathing chamber when the vehicle goes through water.

The disadvantage here is that special means always need to be provided to assure dirt-free breathing of the breathing chamber. Another disadvantage of the first work cylinder named above is that installation of the sensor takes up space.

OBJECT AND SUMMARY OF THE INVENTION

The work cylinder referred to at the outset above, as defined hereinafter has an advantage over the prior art that no special means are needed to guide the breathing air.

It is also advantageous that no special surrounding needs to be provided for installing the sensor.

Other advantageous features of the invention are attained by other provisions set forth herein.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
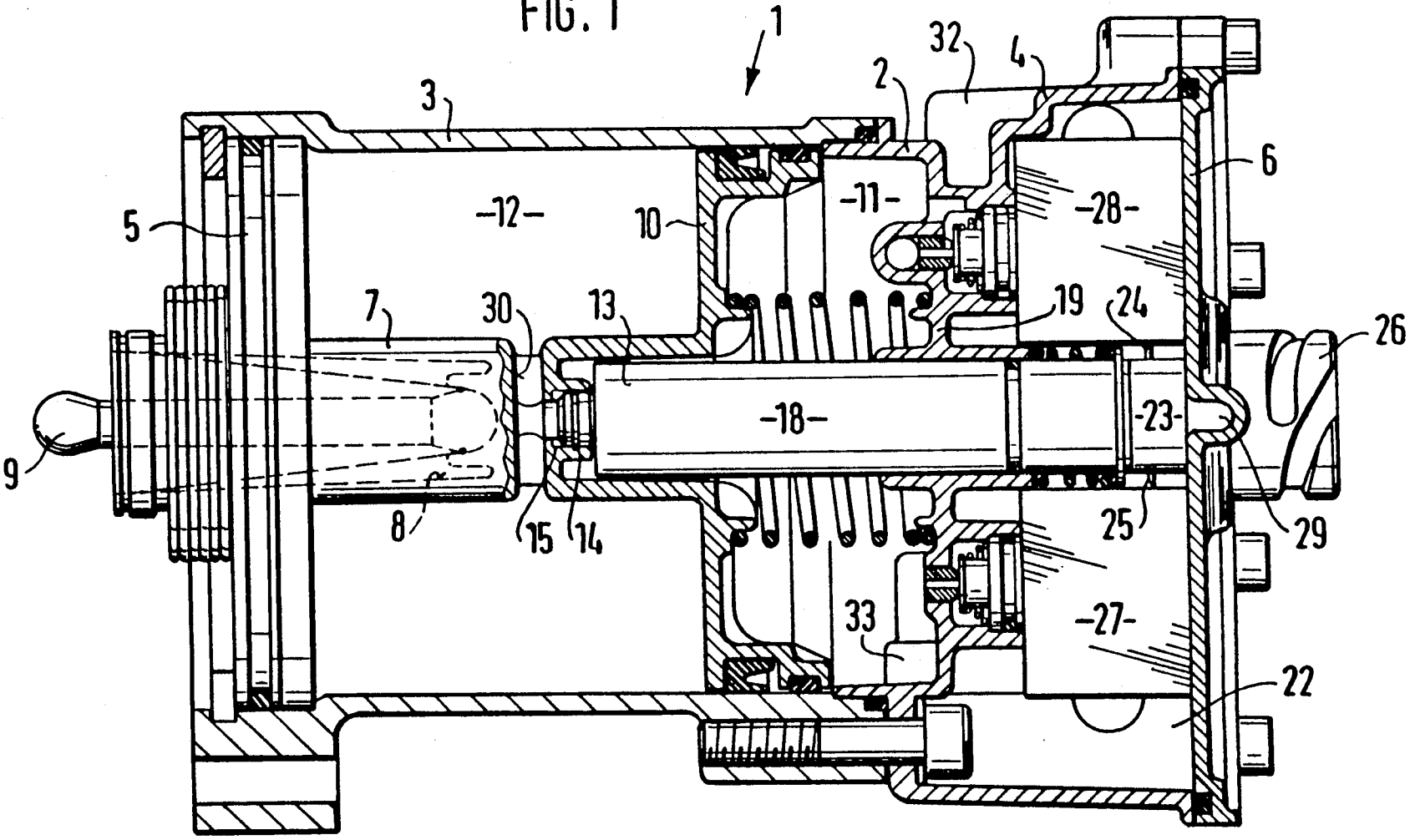
FIG. 1 shows cross sectional view of a work cylinder with a sensor.

A work cylinder 1 has a housing 2, which comprises a largely smooth-walled cylinder part 3 and a connecting part 4, as well as end lids 5 and 6 each for the cylinder part and the connecting part. The lid 5 intended for the cylinder part 3 has a central hole, through which one end of a piston rod 7 protrudes to the outside in a sealed manner.

The piston rod 7 has a recess 8 for receiving a pressure rod 9, with which a clutch, not shown, can be actuated, or in other words engaged and disengaged.

The piston rod 7 has a work piston 10 on its other end, which divides a work chamber 11 from a breathing chamber 12 oriented toward the lid 5 in the work cylinder 1. The piston rod 7 is connected to a hollow-cylindrical plunger body 13, which is provided with an axial conduit 13' and is secured to the piston rod 7 by means of a snap ring 14 and a sealing ring 15. On one end, the plunger body 13 is defined by a radial conduit 30, which discharges into the breathing chamber 12. The axial passage 13' extends to an ambient air connection 31 which is provided on the other end of the plunger body 13 (see FIG. 2).

Figure 2:
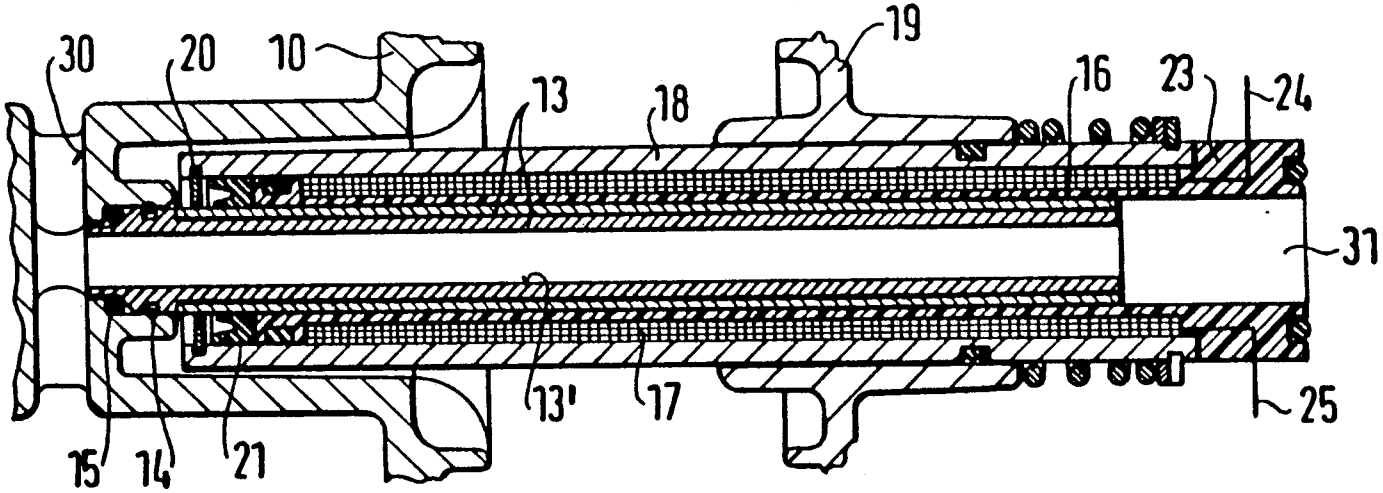
FIG. 2 shows a cross sectional view of the sensor on a larger scale.

The plunger body 13 is of aluminum material, and as best shown in FIG. 2 has a plastic coil body 16 fitting over it that carries the windings of a coil 17, which is surrounded by a shielding sleeve 18 of ferritic material. The plunger body 13, the coil body 16 with the coil 17, and the shielding sleeve 18 form a sensor 13, 16, 17, 18. The shielding sleeve 18 is supported in a partition 19, and on its end oriented toward the work piston 10, it has a sleeve seal 21, which is fixed by means of a snap ring 20 and can slide on the jacket face of the plunger body 13.

By its end remote from the work piston 10, the coil body 16, along with the shielding sleeve 18, protrudes into a control unit chamber 22 which includes connecting wires and other operative elements. There, it is provided with a head 23, through which two coil connections 24 and 25 are passed. The connections 24 and 25 are connected to an electronic system 32, which in turn is electrically conductively connected to a central plug 26 that is secured to the lid 6.

The partition 19 receives two magnet valves in axially parallel arrangement: one aerating magnet valve 27 and one venting magnet valve 28, which protrude into the control unit chamber 22. The aerating magnet valve 27 is connected to a source of compressed air 33, and the venting magnet valve 28 and the control unit chamber are connected with an ambient air point 29.

Mode of Operation

The work cylinder 1 is intended to actuate a clutch, which in the position of the work piston 10 shown is fully engaged. To release the clutch, the aerating magnet valve 27 is switched over. Compressed air flows into the work chamber 11, and the work piston 10 moves to the left. In this process the breathing chamber 12 shrinks in volume, and the breathing air flows through the axial conduit 13+ of the plunger body 13 via the lid 6 to the ambient air.

For clutch re-engagement, the aerating magnet valve 27 is switched off, and the venting magnet valve 28 is switched on. The work chamber 11 is vented. The springs provided in the clutch, which are made taut when the clutch is released, now press the work piston 10 to the right, toward the outset position, via the pressure rod 9.

Since the breathing chamber 12 increases in size in this process, compressed air from the work chamber 11 is aspirated into the breathing chamber 12. Accordingly, the breathing chamber 12 breathes either the ambient air, or air from the work chamber 11, in and out; in any case, the route for the breathing air always goes through the axial conduit 13' of the hollow sensor 13, 16, 17, 18. The breathing air that flows through the control unit chamber 22 and the hollow sensor 13, 16, 17, 18 can also cool the sensor.

Once venting of the work chamber 11 is ended, the work piston 10 resumes its right-hand terminal position, in which the clutch is fully engaged. The hollow-cylindrical sensor 13, 16, 17, 18 functions as a position sensor for the work piston 10, by measuring the travel covered by the work piston at any given time. To this end, an alternating current is applied to the coil 17, and as a result, with a variation in the depth to which the plunger body 13 plunges, a corresponding electrical signal is obtained, which is evaluated in an electric switch device.

The alternating current applied to the coil 17 is a high-frequency alternating current which produces a magnetic field along the coil 17. The magnetic field causes an eddy current in the plunger body 13, which is of aluminum material. The eddy current in turn weakens the magnetic field of the coil 17; that is, it reduces its inductivity, which can be ascertained in an evaluation circuit by means of a voltage measurement. The extent of the change in inductivity provides a standard for the stroke of the work piston 10. Obviously, as the plunger body moves relative to the coil 17, the magnetic field will be affected less by the plunger body.

The control unit chamber 22 serves to hold the magnet valves 27 and 28 along with the head 23 of the sensor 13, 16, 17, 18. By means of the magnet valves 27, 28, the control unit chamber 22 is connected to the work chamber 11 of the work cylinder 1. The control unit chamber 22 also communicates with the ambient air through the ambient air point 29. In addition, however the hollow sensor 13, 16, 17, 18 also communicates with the ambient air point 29. Thus, if the venting magnet valve 28 is opened when the work chamber 11 is filled with compressed air, then compressed air flows out of the work chamber 11 to the ambient air point 29. Upon venting of the work chamber 11, this chamber is reduced in volume, while the breathing chamber 12 increases its volume, since the work piston 10 is displaced to the right. A vacuum accordingly arises in the breathing chamber 12, while even high pressure than in the ambient air prevails at the ambient air point 29, because of the compressed air given up by the work chamber 11. Air derived from the work chamber 11 accordingly reaches the ambient air point 29 through the hollow sensor 13, 16, 17, 18 and the radial conduit 30 in the piston rod 7 to reach the breathing chamber 12 of the work cylinder 1. Accordingly, the breathing chamber 12 breathes air from the work chamber 11. Contrarily, if compressed air is fed into the work chamber 11 by opening the aerating magnet valve 27, the volume of the breathing chamber 12 decreases, then the excess air is given up to the atmosphere from the breathing chamber 12 through the radial conduit 30 of the piston rod 7, the axial conduit 13' of the hollow sensor 13, 16, 17, 18 and the ambient air point 29. Air drawn from the breathing chamber 12 can therefore not reach the work chamber 11.

In this way, not only travel measurement but also various clutch engagement speeds are attainable.

In modification of the system, four magnet valves can be used instead of the two magnet valves 27 and 28. Thus the work piston 10 can be positioned exactly, with the aid of the hollow-cylindrical position sensor 13, 16, 17, 18. To this end, the four magnet valves are controlled directly via the electronic system. Two magnet valves at a time are used for releasing the clutch and for engaging the clutch; each set of two magnet valves is followed by diaphragms of different diameters. By frequency-modulated and/or pulse-width-modulated triggering of the magnet valves, various engagement speeds of the clutch can then be achieved.

The foregoing relates to a preferred exemplary embodiment of the invention, it being understood that other variants and embodiments thereof are possible within the spirit and scope of the invention, the latter being defined by the appended claims.

What is claimed is:

1. A work cylinder which includes a work piston (10) that separates a work chamber (11) from a breathing chamber 912), a piston rod (7) secured to said work piston, said piston rod penetrates the breathing chamber and actuates some operative device, a sensor operative with movement of said work piston that determines a position of the piston rod, the piston rod (7) includes an extension which passes through the work chamber (11) and the piston rod extension is provided with an axial passage (13') which connects with an ambient air source, the piston-rod extension passes through a partition (19) defining the work chamber (11) to conduct ambient air to the breathing chamber (12) via the axial conduit (13') and a radial conduit (30); and the sensor (13, 16, 17, 18) is formed in part by the piston rod extension forming said axial passage (13'), a control unit chamber (22) is disposed on a side of the partition 19 remote from the work chamber 11, at least one valve (28) for venting the work chamber (11) is disposed in the control unit chamber (22); and the control unit chamber (22) and the at least one venting valve 28 communicates with an ambient air point (29), with which the breathing chamber (12) likewise communicates, through the axial conduit 13' of the sensor (13, 16, 17, 18) and the radial conduit (30) of the piston rod 7.

2. A work cylinder as defined by claim 1, in which the sensor (13, 16, 17, 18) is disposed in a region in which the piston rod extension passes through the work chamber and is embodied as a hollow-cylindrical sensor.

3. A work cylinder as defined by claim 2, in which said hollow-cylindrical sensor (13, 16, 17, 18) includes a plunger body (13) which communicates at one end with said radial conduit (30) of the piston rod (7), that said radial conduit discharges into the breathing chamber (12), and the plunger body (13) includes on its other end a second axial passage (31) to an ambient air connection.

4. A work cylinder as defined by claim 3, in which the sensor is embodied as a tubular sensor in which said plunger body (13) is a hollow-cylindrical plunger body of aluminum material, a likewise hollow-cylindrical coil body (16) surrounds said plunger body, a coil (17) surrounds said coil body (16), and a hollow-cylindrical shielding sleeve (18) surrounds said coil 17.

5. A work cylinder as defined by claim 4, in which the plunger body (13) is secured to the work piston (10).

6. A work cylinder as defined by claim 4, in which the coil body (16) along with the coil (17) and the shielding sleeve (18) are supported on the partition (19).

7. A work cylinder as defined by claim 3, in which the breathing air for the breathing chamber (12) is taken from the work chamber (11) via the hollow sensor (13, 16, 17, 18).

8. A work cylinder as defined by claim 2, in which the breathing air for the breathing chamber (12) is taken from the work chamber (11) via the hollow sensor (13, 16, 17, 18).

9. A work cylinder as defined by claim 1, in which the partition (19) supports an aerating magnet valve (27) and said at least one venting valve (28), which is a magnet valve, in an axially parallel arrangement, each of said valves (27, 28) are functionally connected with said chamber (11).

10. A work cylinder as defined by claim 1, in which the work cylinder (1) is used to actuate a clutch plate for actuating a clutch for vehicle engines, and that the signals of the sensor (13, 16, 17, 18), indicates the position at a given time of a work piston (10), and the speed of the piston, can be evaluated in an electronic switch device for the clutch.

* * * * *